United States Patent [19]

Krueger et al.

[11] Patent Number: 4,957,567

[45] Date of Patent: Sep. 18, 1990

[54] FATIGUE CRACK GROWTH RESISTANT NICKEL-BASE ARTICLE AND ALLOY AND METHOD FOR MAKING

[75] Inventors: Daniel D. Krueger; Robert D. Kissinger, both of Cincinnati; Richard G. Menzies, Wyoming; Carl S. Wukusick, Cincinnati, all of Ohio

[73] Assignee: General Electric Company, Cincinnati, Ohio

[21] Appl. No.: 284,008

[22] Filed: Dec. 13, 1988

[51] Int. Cl.[5] ..... C22F 1/10

[52] U.S. Cl. ..... 148/12.7 N; 148/410

[58] Field of Search ..... 148/11.5 N, 12.7 N, 148/410, 428

[56] References Cited

U.S. PATENT DOCUMENTS 3,457,066 7/1969 Pohlman et al. ..... 75/171

3,576,681 4/1971 Barker et al. ..... 148/32

3,890,816 6/1975 Allen et al. ..... 75/0.5

*Primary Examiner*—R. Dean

*Attorney, Agent, or Firm*—Jerome C. Squillaro; Carmen Santa Maria

[57] ABSTRACT

An article having improved fatigue crack growth resistance is provided through an improved nickel-base superalloy and an improved method which controls grain size and a strain rate found to be critical in processing. The alloy is selected to have a gamma prime content in the range of about 30–46 volume percent and a resistance to cracking upon rapid quenching from a selected supersolvus solutioning temperature to a selected quenching temperature. The article produced has an improved balance and combination of fatigue crack growth resistance and tensile, creep, and stress rupture properties.

20 Claims, 4 Drawing Sheets

FATIGUE CRACK GROWTH RESISTANT NICKEL-BASE ARTICLE AND ALLOY AND METHOD FOR MAKING

The Government has rights in this invention pursuant to Contract F33657-84C-2011E awarded by the United States Department of the Air Force.

This invention relates to an improved nickel-base superalloy article, alloy and method and, more particularly, to such an article having a combination of high strength and tolerance to defects for use in a temperature range from ambient up to about 1400° F.

BACKGROUND OF THE INVENTION

The elevated temperature strength of precipitation hardened nickel-base superalloys has encouraged their widespread use in aircraft gas turbine engine components. For components such as turbine disks and seals, the development of improved nickel-base superalloy materials has historically been aimed at achieving higher tensile, creep, and stress-rupture strengths. Improvements in these properties can permit increased engine performance and efficiency. Within recent years, there has also been a growing demand for greater fatigue resistance. This need has been driven by the strong desire to precisely define component life and establish engine durability. Improvements in fatigue resistance reduce life cycle costs and the frequency of in-service inspections. It has also been observed that the sensitivity to fatigue failure usually increases as material strength levels and component operation temperatures are raised. In some cases, critical disk components have even become fatigue limited, prompting much attention to fatigue property characterization and improvement during alloy and process development programs.

Current design methodologies for turbine disks typically use fatigue properties, as well as conventional tensile, creep, and stress-rupture properties for sizing and life analyses. In many instances, the most suitable means of quantifying fatigue behavior for these analyses is through the determination of crack growth rates as described by linear elastic fracture mechanics (LEFM). Under LEFM, the rate of fatigue crack propagation per cycle (da/dN) is a single-valued function which can be described by the stress intensity range, delta K, defined as Kmax-Kmin. Delta K serves as a scale factor to define the magnitude of the stress field at a crack tip and is given in general form as delta K=f(stress, crack length, and geometry).

For improved disks, it has become desirable to develop and use materials which exhibit slow, stable crack growth rates, along with high tensile, creep, and stress-rupture strengths. The development of new nickel-base superalloy materials which offer simultaneously the improvements in, and/or an appropriate balance of tensile, creep, stress-rupture, and fatigue crack growth resistance, essential for advancement in the aircraft gas turbine art, presents a sizeable challenge. The challenge results from the competition between desirable microstructures, strengthening mechanisms, and composition features. The following are typical examples of competition: (1) A fine grain size, for example a grain size smaller than about ASTM 10, is typically desirable for improving tensile strength while a coarse grain size, for example a grain size greater than about ASTM 10, is desirable for improving creep, stress-rupture, and crack growth resistance; (2) Small shearable precipitates are desirable for improving fatigue crack growth resistance under certain conditions, while shear resistant precipitates are desirable for high tensile strength; (3) High precipitate-matrix coherency strain is desirable for high tensile strength while low coherency strain is typically desirable for good stability, creep-rupture resistance, and probably good fatigue crack growth resistance; (4) Generous amounts of refractory elements such as W, Ta, or Nb, can significantly improve strength but must be used in moderate amounts to avoid unattractive increases in alloy density.

Once compositions exhibiting attractive mechanical properties have been identified in laboratory scale investigations, there is also a considerable challenge in successfully transferring this technology to large full-scale production hardware, for example turbine disks of diameters up to, but not limited to, 25 inches. These problems are well known in the metallurgical arts. There has not been reported a nickel-base superalloy material which provides an enhanced, beneficial balance of strength, creep, stress-rupture, and fatigue crack growth resistance, or an alloy-process combination, that would allow full scale production implementation and practical engineering use of such material.

SUMMARY OF THE INVENTION

Briefly, the present invention, in one form, provides a method of making a nickel-base superalloy article in which the superalloy is worked within a specific range of strain rate to avoid abnormal, or critical, grain growth. A more specific form of the invention provides a method of making an article from a gamma prime precipitation strengthened nickel-base superalloy which includes about 30–46 volume percent gamma prime content, which has a predetermined critical strain rate for subsequent preselected working conditions, and which has a quench crack resistance to enable rapid quenching substantially without cracking from a supersolvus solutioning temperature which is adequate to a preselected quenching temperature. The method includes working the superalloy at the working conditions and at a strain rate no greater than a predetermined critical strain rate $E_c$ to provide a worked structure having a grain size substantially no larger than about ASTM 10, along with precipitates which include gamma prime and MC carbides. Then this prepared worked structure is heated at the supersolvus solutioning temperature which is adequate to solution substantially all of the gamma prime but not the MC carbides as well as to coarsen grains uniformly (i.e., substantial absence of critical grain growth) to an average grain size in the range of about ASTM 2–9. The quench crack resistance of the superalloy enables rapid quenching of the structure thus created to a quenching temperature to reprecipitate gamma prime without substantial cracking of the structure.

After such processing, the structure can be aged to provide an article having an enhanced, beneficial balance and combination of properties of tensile, creep, stress rupture and fatigue crack growth resistance, particularly for use from ambient up to a temperature of about 1400° F.

Provision of the nickel-base superalloy having a gamma prime content in the range of 30–46 volume percent, and preferably 33–46 volume percent, with a composition and grain size which results in a strain rate sensitivity, m, of at least 0.3 at working conditions, along with quench crack resistance, enables practice of the method of the present invention.

DESCRIPTION OF THE PREFERRED EMBODIMENTS

Figure 1:
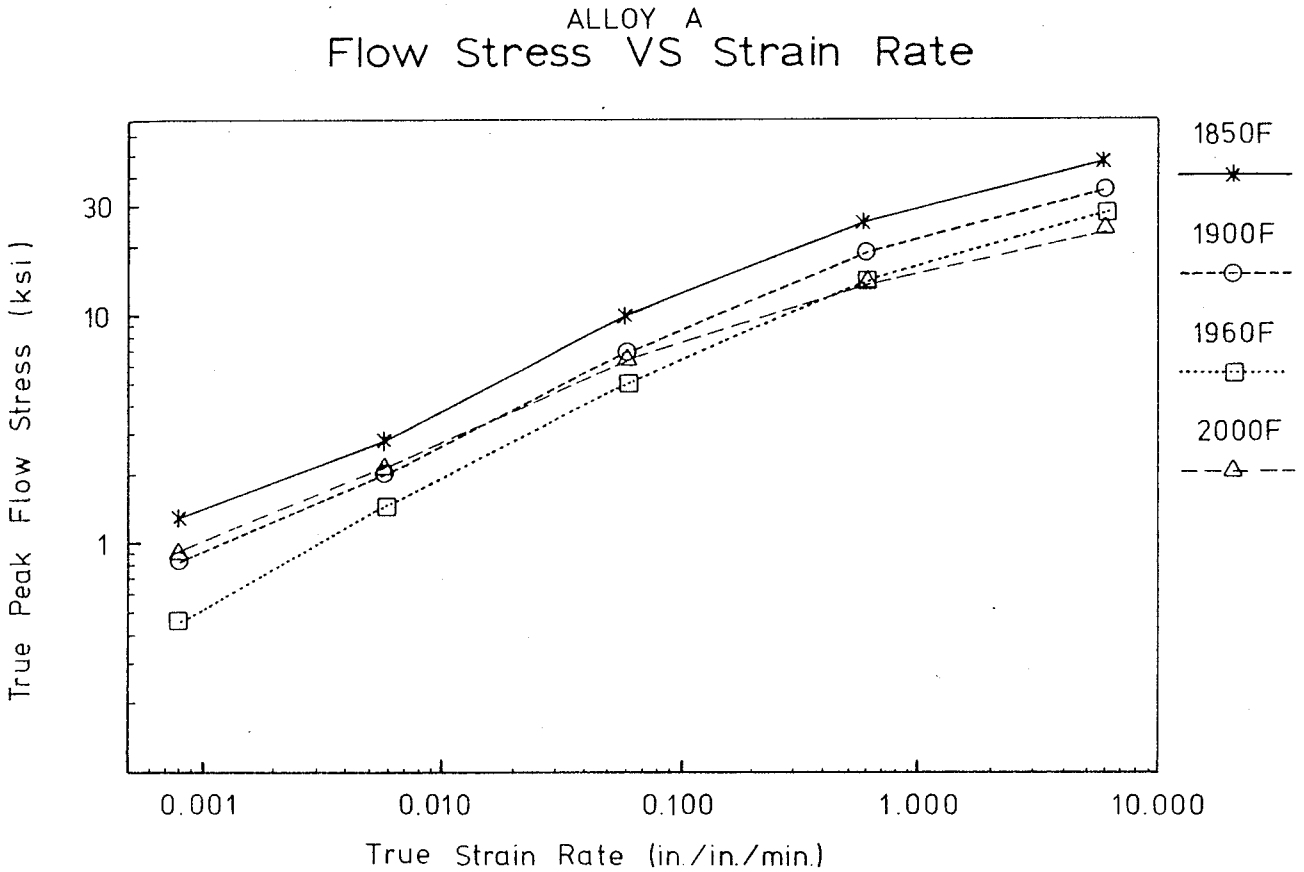
FIG. 1 is a graphical presentation of flow stress vs. strain rate of Alloy A at various temperatures, and an average grain size of about ASTM 12, as large as ASTM 10.

The present invention in one form has recognized a unique combination of nickel-base superalloy composition and processing. The combination provides, reproducibly, a remarkable balance of tensile, creep, stress rupture, and fatigue crack growth properties particularly suitable for use in making articles requiring high strength and excellent fatigue resistance from ambient at least up to about 1400° F. One particularly important form of the present invention is in the manufacture of an article by powder metallurgical techniques including hot extrusion for consolidation, near-net-shape isothermal forging for working and then the supersolvus solutioning, rapid quenching, and aging heat treatments mentioned above.

In a preferred form of the composition of the nickel-base superalloy associated with the present invention, Al and Ti are the principal elements which combine with Ni to form the desired amount of gamma prime precipitate, principally $Ni_3$ (Al, Ti). The elements Ni, Cr, W, Mo, and Co are the principal elements which combine to form the gamma matrix. The principal high temperature carbide formed is the MC type in which M predominately is Nb, Zr, and Ti. With this type of alloy, the method of the present invention provides critical working or deformation steps to provide a worked structure having a grain size no larger than about ASTM 10. Then this alloy-structure combination is fully solutioned (except for high temperature carbides) at a supersolvus temperature while the worked grain structure simultaneously recrystallizes and coarsens uniformly to an average grain size of about ASTM 7, with a range of about ASTM 2-9. As used herein, the term "uniformly", "uniform", etc. in respect to grain growth means the substantial absence of critical grain growth. A preferred form of the present invention provides for a careful control of the cooling rate from the supersolvus solutioning temperature in a rapid quench procedure.

Appreciation of the present invention will be enhanced by an understanding and definition of terms used herein. Throughout this specification, reference to ASTM grain sizes is in accordance with a standard and scale established and published by the American Society for Testing and Materials. In addition, the strain rate during deformation was recognized, according to this invention, to be critical. Therefore, the term $E_c$ herein means a critical strain rate which, when exceeded during the deformation/working steps, and accompanied by a sufficient amount of total strain will result in critical grain growth after supersolvus heat treatment in those locations at which $E_c$ was exceeded.

$E_c$ can be determined for a selected alloy by deforming test specimens under various strain rate conditions. Then the worked specimens are heat treated above the gamma prime solvus temperature (for example, typically about 50° F. above the solvus temperature) and below the alloy's incipient melting temperature. Herein such a heat treatment is referred to as "supersolvus" in respect to heating, heat treatment, etc. The exact value of $E_c$ also can depend upon the amount of strain imparted into the specimen at a given strain rate whereby critical grain growth can be observed after a supersolvus heat treatment. According to the present invention, a superalloy structure or member, for example in the form of a billet or powder metallurgy compact, with a grain size no larger than about ASTM 10, is worked or deformed, prior to heat treatment, at a strain rate less than a predetermined critical strain rate, $E_c$, which will result in critical grain growth. Then the worked structure is supersolvus heat treated.

The value of $E_c$ is composition and microstructure dependent in the present invention: the gamma prime content herein is calculated, consistent with experimental data, to be in the range of about 30 to 46 volume percent and the grain size after working is no larger than about ASTM 10.

According to one form of the present invention, especially associated with a later described Alloy A, there is a critical relationship between strain rate, abnormal grain growth, and high temperature flow behavior. For example, using data of flow stress vs. strain rate behavior for a selected alloy, a strain rate sensitivity parameter, "m", is determined as d [$ln$ (flow stress)]/d[$ln$ (strain rate)] and then plotted as a function of strain rate. According to one form of the present invention, certain alloys with a strain rate sensitivity value, m, at preselected working conditions, of at least about 0.3 for a given strain rate will not result in critical, abnormal grain growth at the selected strain rate condition: it will deform in a superplastic manner as contrasted with alloys having an m value less than about 0.3 not exhibiting superplastic deformation behavior.

One example of these determinations, conducted during evaluation of the present invention, employed a gamma prime precipitation strengthened nickel-base superalloy, herein called Alloy A, having a nominal composition, in weight percent of 12-14Co, 15-17Cr, 3.5-4.5Mo, 3.5-4.5W, 1.5-2.5Al, 3.2-4.2Ti, 0.5-1Nb, 0.01-0.04B, 0.01-0.06C, 0.01-0.06Zr, up to about 0.01V, up to 0.3Hf, up to 0.01Y, with the balance essentially Ni and incidental impurities. The gamma prime solvus temperature is estimated to be in the range of 1950°-2150° F., typically in the range of about 2025°-2050° F. for about 40 volume percent gamma prime. The gamma prime content was in the range of about 33 to 46 volume percent. One form of the alloy, identified as Alloy A in Table I below and having an average grain size about ASTM 12, as large as ASTM 10, was formed and machined into a tapered tensile specimen and scribed with circumferential fiducial lines. The specimen was strained at room temperature to a nominal plastic strain of 10 percent. Incremental plastic strains were measured between fiducial lines and plotted as a function of gage length. It was observed that the plastic strain increased as the tensile specimen gage diameter decreased. This tapered specimen, which had been strained at room temperature, was then supersolvus heat treated at about 2100° F. for about one hour and air cooled to room temperature. After cutting and polishing the specimen, the macrostructure clearly showed a gradient of increasing grain size with increasing strain. Critical grain growth was observed to initiate in a region of 6–8 percent plastic strain, where the grain size was about ASTM-3 (about 1 mm grain diameter). Based on these procedures, it was determined that Alloy A will exhibit abnormal grain growth when subjected to a critical strain in the range of 6–8 percent at room temperature. However, in another procedure, it was observed that when the tapered specimen of Alloy A was strained at the same nominal strain of 10 percent at an elevated temperature of about 1940° F. rather than at room temperature, the tensile specimen maintained an average grain size of about ASTM 7 and did not show abnormal grain growth subsequent to the same supersolvus heat treatment. Even an increase in nominal strain from 10 percent to 25 percent did not produce critical grain growth when a tapered tensile specimen of Alloy A was strained at about 1940° F.

These results indicate that strain alone is not the primary variable to predict abnormal grain growth primarily during elevated temperature deformation. The present invention recognized, unexpectedly, that critical grain growth primarily is a function of the local strain rate within a structure or article, rather than total strain, during a high temperature working/deformation procedure. Accordingly, the invention recognized that there exists the critical strain rate $E_c$ which, when exceeded during the working process, will result in critical grain growth in those local locations in which $E_c$ was exceeded.

It has been observed that in a log flow stress vs. log strain rate diagram, $E_c$ lies either in a region (Region III) which will not show superplastic deformation behavior, or in a transition between Region III and a region (Region II) which does show superplastic deformation behavior. Such regions as Regions II and III are well known in the metallurgical literature in connection with superplasticity. As was stated above, the exact value of $E_c$ also can depend upon the amount of strain imparted into an article or structure at the strain rate.

Figure 2:
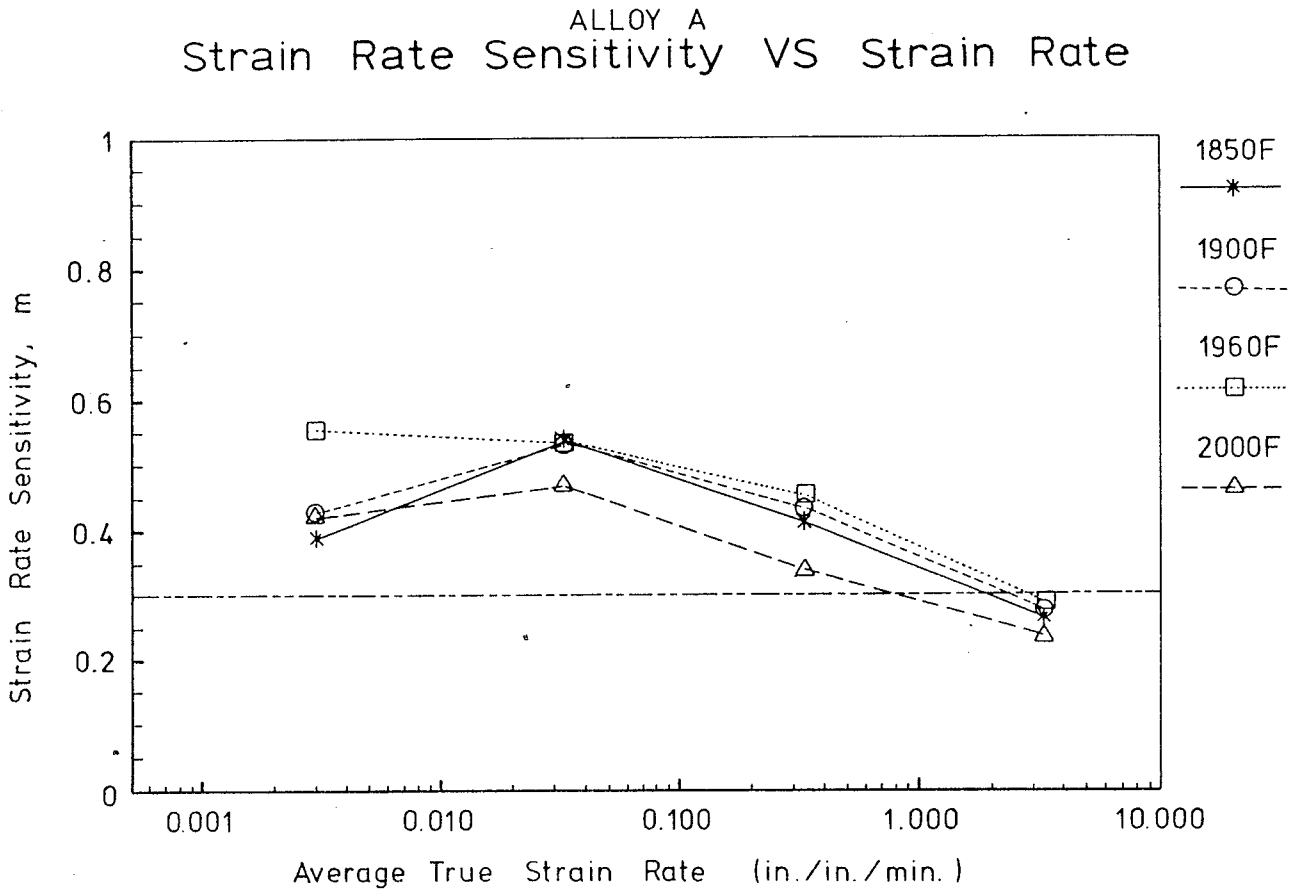
FIG. 2 is a graphical comparison of the strain rate sensitivity parameter m with strain rate for Alloy A, average grain size about ASTM 12, as large as ASTM 10.

These observations were developed from evaluations conducted with the above identified Alloy A using standard tensile specimens and full scale isothermally forged components from aircraft gas turbine engines. Initially, the flow stress vs. strain rate behavior of the alloy was characterized at various isothermal forging temperatures as shown in the graphical presentation of FIG. 1 for a 3 inch diameter billet worked by extrusion below the gamma prime solvus and having an average grain size of about ASTM 12, as large as ASTM 10. From these data, the above identified strain rate sensitivity parameter m, defined as d[1*n* (flow stress)]/d[1*n* (strain rate)], was plotted against strain rate. This plot is shown in the graphical presentation of FIG. 2. A horizontal line at m=0.3 has been included in FIG. 2. According to the present invention, certain alloys, such as Alloy A, with a strain rate sensitivity value m of at least about 0.3 at the working conditions for a given strain rate will not result in critical, abnormal grain growth at the selected strain rate condition.

As a further example of the recognitions of the present invention, standard tensile specimens of Alloy A were deformed at about 1960° F. at strain rates of 0.6 in/in/min (m=0.42) in the superplastic Region II to an average grain size of about ASTM 12, as large as about ASTM 10, and at 6 in/in/min (m=0.25) in the non-superplastic Region III to an average grain size of about ASTM 12, as large as ASTM 10. After a supersolvus solution heat treatment at 2100° F. for about one hour and air cooling to room temperature, the specimen deformed in Region III exhibited abnormal grain growth to grain size of ASTM -3, whereas the specimen deformed in Region II did not.

In another example of the evaluation of the present invention, data for flow stress and the value m vs. strain rate for Alloy A were generated from a 9 inch diameter billet. Full scale gas turbine engine disks were forged at various strain rates and temperatures below the gamma prime solvus of 2025°–2050° F. to an average grain size of about ASTM 12, as large as ASTM 10. Disks forged at strain rates in Region II exhibited no abnormal grain growth. Disks forged at strain rates in the Region II-III transition above the critical strain rate $E_c$ showed significant abnormal grain growth to ASTM -3.

Figure 3:
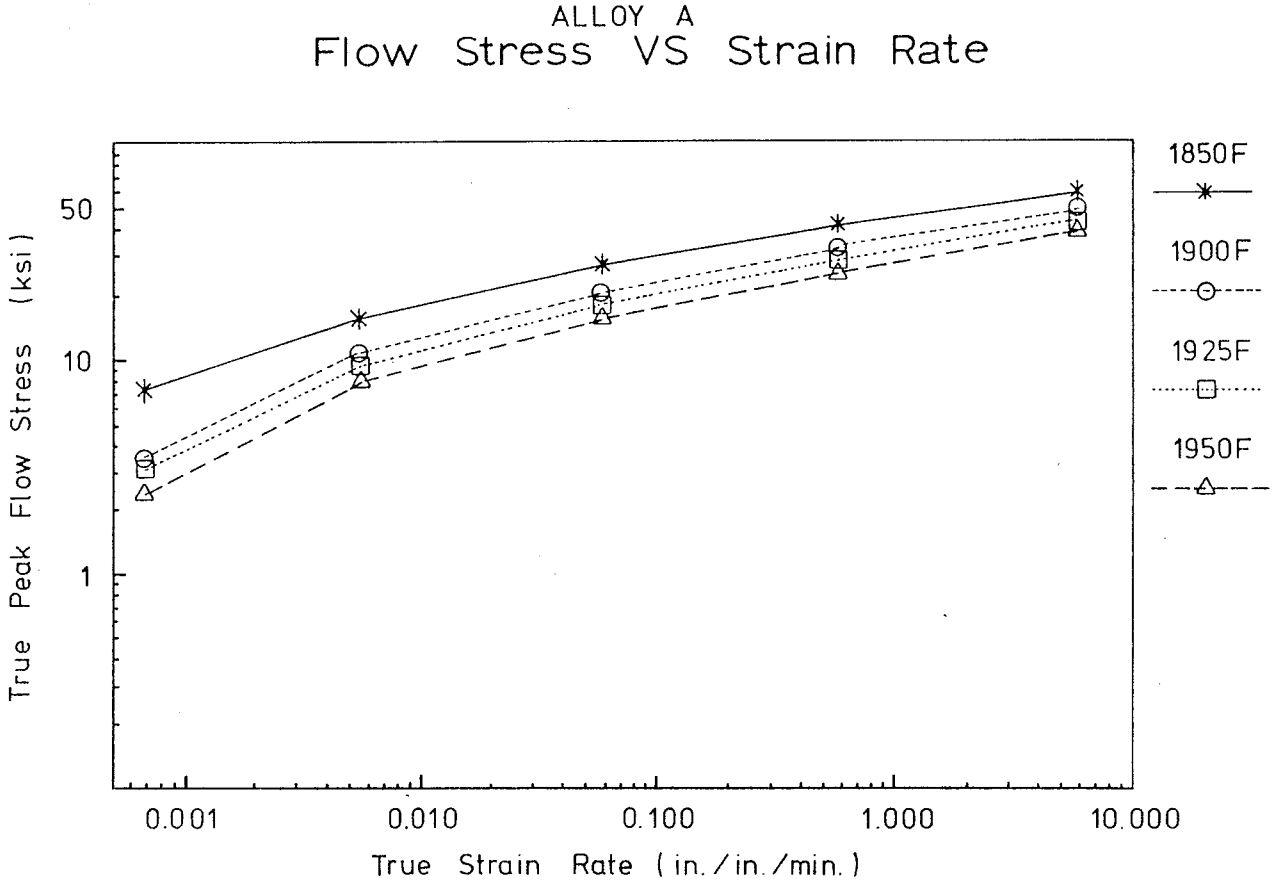
FIG. 3 is a graphical comparison of flow stress vs. strain rate of Alloy A at various temperatures and an average grain size of about ASTM 9, as large as ASTM 7.
Figure 4:
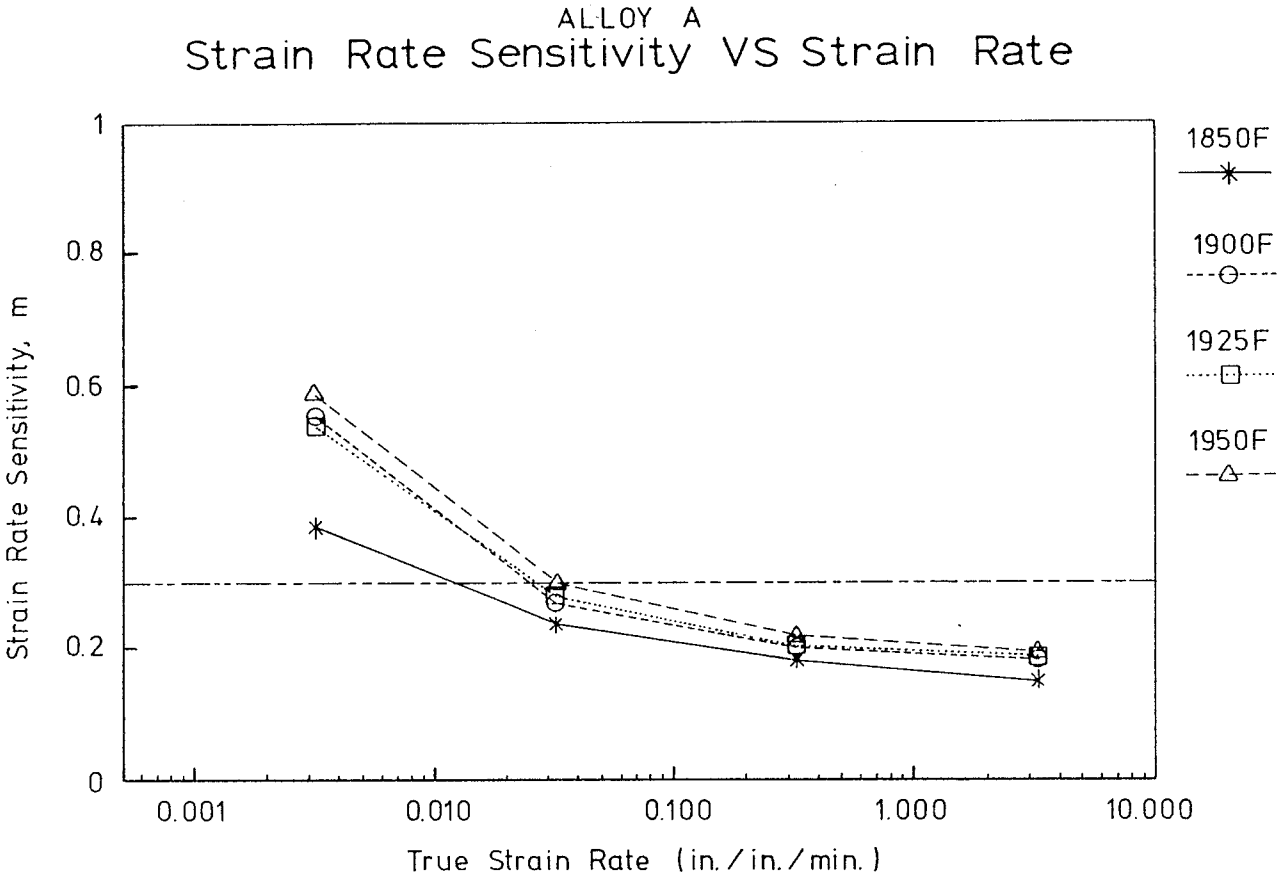
FIG. 4 is a graphical comparison of the strain rate sensitivity parameter m with strain rate for Alloy A, average grain size about ASTM 9, as large as ASTM 7.

Superimposed on these discoveries is the fact that the critical strain rate necessary to produce abnormal grain growth is very sensitive to microstructure, especially grain size. With certain alloys, this sensitivity is related to the strong dependence of flow stress, and therefore the value of m, on grain size. For instance, in the example discussed above in connection with the 9 inch diameter billet, the average grain size of the specimen was about ASTM 12, as large as ASTM 10. It was observed that if the grain size was coarsened to about an average ASTM 9, as large as ASTM 7, the resulting deformation behavior changed for Alloy A, to that shown in the graphical presentation of FIGS. 3 and 4. Note the position of the line m=0.3 in FIG. 4. Accordingly, for a given strain rate, a coarser grain size will have a higher flow stress, especially at the lower strain rates as shown in FIG. 3. Also, the peak in the m vs. strain rate curve will shift to the left on the graph (lower strain rates) as the grain size increases. Therefore, a feature of the present invention is to provide the worked structure with a fine grain size, herein defined as being no larger than about ASTM 10.

A wide variety of published data has observed, and it is generally recognized in the metallurgical art, that in nickel-base superalloys of the general type of Alloy A, an increase in volume percent of gamma prime increases high temperature strength. Therefore, certain of the more recently developed nickel-base superalloys for high temperature operation in gas turbine engines have included gamma prime contents of at least about 50 volume percent and generally higher for strength enhancement. The gamma prime level of a nickel-base superalloy and supersolvus temperature for solutioning are related to the crack sensitivity of the alloy during rapid quenching after solutioning to enhance strength properties. The higher the gamma prime content and hence the higher the gamma prime solvus temperature, the greater will be the thermal shock and change in internal strain as gamma prime precipitates upon cooling. The result of such higher gamma prime levels is a greater susceptibility for cracking of a member during rapid quenching from a supersolvus solutioning. During the evaluation of the present invention, a variety of nickel-base superalloys were studied for quench crack sensitivity. The following Tables I and II identify some of such alloys, including Alloy A referred to above, and present the strength and quench crack sensitivities.

TABLE I

| NOMINAL ALLOY COMPOSITION 0.015% B, 0.05% C, 0.05% Zr, Balance Ni and incidental impurities | | | | | | | | | | | |
|---|---|---|---|---|---|---|---|---|---|---|---|
| | ELEMENTS (wt. percent) | | | | | | | | | GAMMA PRIME | |
| Alloy | Co | Cr | Mo | W | Ta | Al | Ti | Nb | Hf | Solvus(°F.) | Vol % |
| A | 13 | 16 | 4 | 4 | — | 2.1 | 3.7 | 0.7 | — | 2025–2050 | 40 |
| B | 8 | 13 | 3.5 | 3.5 | — | 3.1 | 2.3 | 3.1 | 0.2 | 2055–2080 | 45 |
| C | 8 | 13 | 3.5 | 3.5 | — | 3.5 | 2.5 | 3.5 | — | 2100–2125 | 50 |
| D | 15 | 10 | 3 | — | 4.5 | 4.9 | 2 | 2.4 | — | 2200–2225 | 61 |

TABLE II

| STRENGTH & QUENCH CRACK SENSITIVITY | | | | |
|---|---|---|---|---|
| | GAMMA | | AVERAGE 750° F. TENSILE STR. | |
| ALLOY | PRIME (Vol %) | QUENCH CRACKING | 0.2% OFFSET YIELD STR. (ksi) | ULTIMATE TENSILE STR. (ksi) |
| A | 40 | NO | 161 | 214 |
| B | 45 | YES | 155 | 205 |
| C | 50 | YES | 161 | 212 |
| D | 61 | YES | 155 | 200 |

All of the alloys in the above tables were prepared by ordinary powder metallurgy and consolidated by extrusion to an average grain size of about ASTM 12, as large as ASTM 10. Compaction of the containerized powder was at a temperature below each gamma prime solvus and a pressure which resulted in at least 98 percent theoretical density; working of the compacted material was at an area reduction ratio of about 6:1 and a temperature below the gamma prime solvus to yield a fully dense, fine grain billet. The billets thus prepared were cut into lengths suitable for isothermal forging into near-net-shape turbine disk configurations having diameters of about 25 inches and weighing about 350 pounds.

Alloys A, B, C, and D were isothermally forged to an average grain size of about ASTM 12, as large as ASTM 10, with a temperature and strain rate that yielded a strain rate sensitivity, m, of about 0.5. Alloys A, B, C, and D subsequently were supersolvus heat treated. The heat treatment included a preheat treatment at each alloy's isothermal forging temperature for about 1–2 hours, followed by a direct heating to the supersolvus solution temperature (approximately 50° F. above each alloy's gamma prime solvus temperature). Each disk was held at the supersolvus solution temperature for about one hour, followed by a brief air cool (up to about 5 minutes) before being quenched into oil. Only Alloy A did not crack.

Reported information has shown that gamma prime strengthened nickel-base superalloys covering a wide range in composition are amenable to powder metallurgy processing, fine grain billet manufacture, and isothermal forging of the billet to achieve complex, near-net-shape configurations. This ease of processing, however, does not typically extend to heat treatment, especially when the solution treatment temperature is above the gamma prime solvus temperature. As can be seen from the data of Table II, all of the alloys, with the exception of Alloy A, cracked as a result of rapid quenching from a supersolvus solutioning temperature. Quenching involved rapid cooling at a rate to obtain properties of about 158 ksi for 0.2% offset yield strength and 212 ksi for ultimate tensile strength. It can been seen that the tendency for cracking as a result of such quenching increases as the gamma prime volume fraction increases, or, as a minimum, that alloys with gamma prime volume fraction greater than Alloy A experienced cracking when cooled at a rate necessary to obtain selected properties.

As has been mentioned, one feature of the present invention is the provision of an article having a uniform (substantial absence of critical grain growth) microstructure with an average grain size in the range of about ASTM 2–9, for example about ASTM 7, as large as ASTM 2. This microstructure allows for provision of the best combination of tensile, creep, rupture, and fatigue properties as previously discussed.

In another series of evaluations of alternate methods of processing Alloy A, heats of the alloy were prepared by powder metallurgy, consolidated by hot isotatic pressing or extrusion, and heat treated to produce a microstructure like that described above according to this invention. Key mechanical properties are listed in Table III. It can be seen that the fatigue crack growth, creep, and tensile property performance for each processing variation is comparable.

TABLE III

| | STRENGTH PROPERTIES | | | | | | | | | FATIGUE CRACK GROWTH RATE (20 cycle/min) ($K_{eff}$ = 25 Ksi $\sqrt{inch}$) da/dN (inches/cycle) | | 0.2% Creep at 60 ksi (Larson-Miller Parameter, C = 25) |
|---|---|---|---|---|---|---|---|---|---|---|---|---|
| | ROOM TEMP. | | | 750° F. | | | 1200° F. | | | | | |
| PROCESSING | UTS (ksi) | 0.2 YS (ksi) | % EL | UTS (ksi) | 0.2 YS (ksi) | % EL | UTS (ksi) | 0.2 YS (ksi) | % EL | 750° F. | 1200° F. | |
| Isothermal Forging | 230 | 168 | 20 | 222 | 163 | 18 | 220 | 153 | 20 | $6 \times 10^{-6}$ | $2 \times 10^{-5}$ | 50.2 |
| Hot Isostatic Pressing | | | | 220 | 160 | 15 | 225 | 158 | 20 | | $1.6 \times 10^{-5}$ | |

TABLE III-continued

| PROCESSING | STRENGTH PROPERTIES ROOM TEMP. UTS (ksi) | ROOM TEMP. 0.2 YS (ksi) | ROOM TEMP. % EL | 750° F. UTS (ksi) | 750° F. 0.2 YS (ksi) | 750° F. % EL | 1200° F. UTS (ksi) | 1200° F. 0.2 YS (ksi) | 1200° F. % EL | FATIGUE CRACK GROWTH RATE (20 cycle/min) ($K_{eff}$ = 25 Ksi $\sqrt{inch}$) da/dN (inches/cycle) 750° F. | da/dN 1200° F. | 0.2% Creep at 60 ksi (Larson-Miller Parameter, C = 25) |
|---|---|---|---|---|---|---|---|---|---|---|---|---|
| Extrusion | 232 | 169 | 20 | 206 | 159 | 17 | 229 | 155 | 20 | $5 \times 10^{-6}$ | $1.5 \times 10^{-5}$ | 50.5 |

In the above Table III, in Table IV below and elsewhere herein, "UTS" means ultimate tensile strength; "ksi" means thousands of pounds per square inch; "0.2YS" means 0.2% offset yield strength in ksi; "%EL" means % elongation; and under 0.2% creep, the well known and widely used Larson-Miller parameter is the solution to the relationship $P=T(C+\log t)\times 10^{-3}$, where P is the unitless parameter, T is the temperature in °R, t is the time in hours, and C is a material constant equal to 25. In Table IV, "$K_{eff}$ (ksi $\sqrt{inch}$)" is a well known parameter which normalizes the effects of load ratio, and "da/dN (inch/cycle)" means fatigue crack growth rate.

The following Table IV presents mechanical property data obtained from testing of actual gas turbine engine components made in accordance with the present invention from a superalloy consisting essentially of, in weight percent, 12–14Co, 15–17Cr, 3.5–4.5Mo, 3.5–4.5W, 1.5–2.5Al, 3.2–4.2Ti, 0.5–1Nb, 0.01–0.04B, 0.01–0.06C, 0.01–0.06Zr, with the balance essentially Ni and incidental impurities. The component was aged in the range of about 1200°–1550° F.

TABLE IV

MECHANICAL PROPERTY DATA
FATIGUE CRACK GROWTH RATES (at 20 cycles per minute)

| Temp. (°F.) | $K_{eff}$ (ksi $\sqrt{inch}$) | da/dN (inch/cycle) |
|---|---|---|
| 750 | 25 | $2.78 \times 10^{-6}$–$5.75 \times 10^{-6}$ |
| 1200 | 25 | $1.30 \times 10^{-5}$–$2.16 \times 10^{-5}$ |

TENSILE

| Temp. (°F.) | UTS (ksi) | 0.2% YS (ksi) | % EL |
|---|---|---|---|
| Room | 221–231 | 157–176 | 17–25 |
| 750 | 207–225 | 142–169 | 14–24 |
| 1200 | 214–224 | 142–158 | 14–26 |
| 1400 | 162–171 | 141–149 | 10–20 |

100 Hour 0.2% CREEP STRENGTH
(Larson-Miller parameter, C = 25)

| Stress (ksi) | Temperature (°F.) |
|---|---|
| 70 | 1365–1392 |
| 100 | 1285–1332 |
| 125 | 1200–1255 |

100 HOUR STRESS RUPTURE STRENGTH
(Larson-Miller parameter, C = 25)

| Stress (ksi) | Temperature (°F.) |
|---|---|
| 70 | 1413–1442 |
| 100 | 1340–1396 |
| 125 | 1237–1268 |

The data of Table IV, representative of the present invention, shows the superior balance of fatigue crack growth resistance and tensile properties, for example at 750° F. which is approximately the temperature at the bore of one form of a gas turbine engine disk. Concurrently, the other mechanical properties are in a particularly desirable range for such an application. In this improved balance and combination of properties, the creep, stress rupture, and 1200° F. fatigue crack growth properties are beneficial for the rim of one form of a gas turbine engine disk.

In a preferred form of the method of the present invention, it was recognized that with alloys such as Alloy A, capable of providing desired strength properties for use up to about 1400° F., a controlled quench from the supersolvus solutioning temperature is advantageous. The selected cooling rate is one which is sufficiently rapid to provide the desired properties such as strength and creep and fatigue resistance. Yet it does not thermally shock the structure into a cracked condition. Generally, the supersolvus temperature suitable for this method is less than about 2225° F. and typically about 50° F. above the gamma prime solvus temperature.

It has been found, according to a preferred form of the present invention, particularly with an alloy such as Alloy A, that a quench delay prior to full quenching will reduce the thermal shock in the structure, further inhibiting cracking on full quenching. An example of such quench delay is, after supersolvus solutioning, cooling in air for a short time, such as up to about five minutes, and then rapidly quenching into a medium, such as in oil, salt, etc. Accordingly, the method of the present invention provides for cooling the supersolvus heat treated structure at a rate selected to avoid quench cracks upon quenching and yet provide desired properties. Preferably, such cooling includes a quench delay to reduce thermal shock.

Also, during heating to the supersolvus solutioning temperature, in order to avoid thermal gradient induced strains which can induce critical grain growth, it is preferred that the structure be subjected to a preheat step. Such a step, after working such as by isothermal forging, involves heating the structure near the working temperature and below the gamma prime solvus temperature, for a soak period to equilibrate the temperature. Then the structure is heated directly to the selected supersolvus solution temperature.

As a specific example of a preferred form of the present invention, Alloy A of Table I was vacuum melted to produce an ingot which was made into powder by powder metallurgy gas atomization. The resultant powder was screened, blended, and placed in closed containers of the type used in powder metallurgy for further processing. The containerized powder was compacted at a temperature below the gamma prime solvus and at a pressure which resulted in a density of at least 98% theoretical. The compacted material was extruded at an area reduction ratio of about 6:1 and temperature below the gamma prime solvus to yield a fully dense, fine grained billet of an average grain size about ASTM 12, as large as ASTM 10.

The billet was prepared and sectioned into segments suitable for isothermal forging into near-net-shape configurations. The segments were isothermally forged at a temperature below the gamma prime solvus temperature in vacuum or inert atmospheres and strain rate condition in Region II that yielded a strain rate sensitivity, m, of about 0.5. The forging was preheated in air near the forging temperature and then heated directly to a supersolvus temperature. After a one hour hold at that solution temperature, the forging was removed from the heat treatment furnace for a quench delay cool in air. Then the forging was quenched into agitated oil. No cracking of the forging was observed. Aging was then performed in the usual manner, in the range of 1200°-1550° F., in this example, at 1400° F. for 8 hours, followed by an air cool. The above Tables III and IV include such data as mechanical strength, crack growth rate, and fatigue properties of the structure provided by this specific example.

The present invention has been described in connection with specific examples and embodiments. However, it will be understood by those skilled in the metallurgical arts involved that the invention is capable of variations and modifications within its broad scope represented by the appended claims. For example, the method can be used in connection with the manufacture of structures or articles by powder metallurgy, cast and wrought, etc. Also, the method can be applied to alloys other than the above described Alloy A, which in itself includes unique characteristics such as the combination of composition and gamma prime content to make it particularly adaptable to the method of the present invention.

What is claimed is:

1. In a method of making an article from a gamma prime precipitation strengthened nickel-base superalloy having a gamma prime solvus temperature and an incipient melting temperature, the steps of:

providing a nickel-base superalloy (a) which includes a gamma prime content in the range of about 30-46 volume percent, and (b) which has a quench crack resistance to enable rapid quenching substantially without cracking from a preselected supersolvus solutioning temperature, above the gamma prime solvus temperature and below the incipient melting temperature, to a preselected quenching temperature;

working the superalloy at preselected working conditions, including a working temperature below the gamma prime solvus, at a strain rate less than a predetermined critical strain rate, $E_c$, to provide a worked structure having a grain size substantially no larger than about ASTM 10, a precipitate of gamma prime, and a high temperature carbide precipitate comprising MC carbide;

heating the worked structure at the supersolvus solutioning temperature for a time sufficient to solutionize substantially all of the gamma prime but not the MC carbide, and to coarsen grains uniformly to a range of about ASTM 2-9; and quenching the structure rapidly to the quenching temperature to reprecipitate gamma prime without substantial cracking of the structure.

2. The method of claim 1 for working an article by powder metallurgy in which the superalloy is provided in powder form and is consolidated to a structure of at least about 98% theoretical density and a grain size no larger than about ASTM 10.

3. The method of claim 1 in which the nickel-base superalloy has a strain rate sensitivity, m, of at least 0.3 at the preselected working conditions, m being defined as d[ln (flow stress)]/d[ln (strain rate)].

4. The method of claim 1 in which the superalloy consists, in weight percent, essentially of 12-14Co, 15-17Cr, 3.5-4.5Mo; 3.5-4.5W, 1.5-2.5Al, 3.2-4.2Ti, 0.5-1Nb, 0.01-0.04B, 0.01-0.06C, 0.01-0.06Zr, up to about 0.01V, up to 0.3Hf, up to 0.01Y, with the balance essentially Ni and incidental impurities.

5. The method of claim 4 including, after quenching, heating to an aging temperature in the range of about 1200°-1550° F. to age the gamma prime and to provide the structure with an improved balance and combination of properties, from ambient up to a temperature of about 1400° F., of average tensile, creep, stress rupture and fatigue crack growth resistance, the 750° F. fatigue crack growth rate being in the range of about $2.7\times10^{-6}$ to $6\times10^{-6}$ da/dN (inch/cycle) at 20 cycles per minute and a $K_{eff}$ of 25 ksi $\sqrt{\text{inch}}$.

6. The method of claim 5 in which, in combination with the 750° F. fatigue crack growth rate, the structure has the improved balance of properties of:

750° F. tensile 207-225 ksi UTS; 142-169 ksi 0.2% YS;

1200° F. fatigue crack growth rate of $1.3\times10^{-5}$ to $2.2\times10^{-5}$ da/dN (inch/cycle) at 20 cpm and a $K_{eff}$ of 25 ksi $\sqrt{\text{inch}}$.

100 hour 0.2% creep (C=25) 70 ksi stress, 1365°-1392° F.

100 hour stress rupture (C=25) 70 ksi stress, 1413°-1442° F.

7. The method of claim 1 in which after the solutioning step above the gamma prime solvus and prior to the rapid quenching step:

subjecting the structure to a quench delay of cooling in air for up to about five minutes; and then, rapidly quenching the structure.

8. The method of claim 1 in which, after working the superalloy and prior to heating the worked structure at the supersolvus solutioning temperature:

the structure is preheated below the gamma prime solvus temperature; and then, the structure is heated directly to the supersolvus solutioning temperature.

9. The method of claim 1 comprising the steps of:

providing a nickel-base superalloy consisting essentially of, in weight percent, 12-14Co, 15-17Cr, 3.5-4.5Mo, 3.5-4.5W, 1.5-2.5Al, 3.2-4.2Ti, 0.5-1Nb, 0.01-0.04B, 0.01-0.06C, 0.01-0.06Zr, up to about 0.01V, up to 0.3Hf, up to 0.01Y, with the balance essentially Ni and incidental impurities and which can develop a gamma prime content in the range of about 33 to 46 volume percent, the alloy having a gamma prime solvus in the range of about 1950°-2150° F.;

working the superalloy at a temperature below the gamma prime solvus temperature of the superalloy and at a strain rate in which local strain rates do not exceed $E_c$ to provide a worked structure having an average grain size uniformly in the range of about ASTM 10-14;

heating the worked structure at a supersolvus solutioning temperature above the gamma prime solvus and to coarsen grains to an average grain size in the range of about ASTM 2-9;

subjecting the structure to a quench delay by cooling in air for up to about five minutes; and then, rapidly quenching the structure.

10. The method of claim 9 in which the superalloy has a strain rate sensitivity, m, of at least 0.3 at the preselected working conditions, m being defined as d[ln (flow stress)]/d [ln (strain rate)].

11. The method of claim 9 in which, after quenching, the structure is heated to an aging temperature in the range of about 1200°-1550° F. to age the gamma prime and provide the structure with an improved balance and combination of properties, from ambient up to a temperature of about 1400° F., of average tensile, creep, stress rupture and fatigue crack growth resistance, the 750° F. fatigue crack growth rate being in the range of about $2.7\times10^{-6}$ to $6\times10^{-6}$ at 20 cycles per minute and $K_{eff}$ of 25 ksi $\sqrt{\text{inch}}$.

12. The method of claim 11 in which, in combination with the 750° F. fatigue crack growth rate, the structure has the improved balance of properties of:

750° F. tensile 207-225 ksi UTS; 142-169 ksi 0.2% YS;

1200° F. fatigue crack growth rate of $1.3\times10^{-5}$ to $2.2\times10^{-5}$ da/dN (inch/cycle) at 20 cpm and a $K_{eff}$ of 25 ksi $\sqrt{\text{inch}}$.

100 hour 0.2% creep (C=25) 70 ksi stress, 1365°-1392° F.

100 hour stress rupture (C=25) 70 ksi stress, 1413°-1442° F.

13. The method of claim 9 in which, after working the superalloy and prior to heating the worked structure at the supersolvus solutioning temperature:

the structure is preheated below the gamma prime solvus temperature and then, the structure is heated directly to the supersolvus solutioning temperature.

14. The method of claim 9 for making an article by powder metallurgy in which:

the superalloy is provided in powder form and placed in a closed powder metallurgy processing container;

the containerized powder is compacted at a temperature below the gamma prime solvus temperature and at a pressure which results in a compact having a density of at least 98% theoretical;

the compact is extruded at an area reduction ratio of about 6:1 and at a temperature below the gamma prime solvus temperature to provide a structure having an average grain size in the range of about ASTM 12-14; and at least one segment of the structure is worked by isothermal forging at a temperature below the gamma prime solvus and at a strain rate less than $E_c$.

15. The method of claim 14 including, after quenching, heating to an aging temperature in the range of about 1200°-1550° F. to age the gamma prime and to provide the structure with an improved balance and combination of properties, from ambient up to a temperature of about 1400° F., of average tensile, creep, stress rupture and fatigue crack growth resistance, the 750° F. fatigue crack growth rate being in the range of about $2.7\times10^{-6}$ to $6\times10^{-6}$ da/dN (inch/cycle) at 20 cycles per minute and a $K_{eff}$ of 25 ksi $\sqrt{\text{inch}}$.

16. The method of claim 15 in which, in combination with the 750° F. fatigue crack growth rate, the structure has the improved balance of properties of:

750° F. tensile 207-225 ksi UTS; 142-169 ksi 0.2% YS;

1200° F. fatigue crack growth rate of $1.3\times10^{-5}$ to $2.2\times10^{-5}$ da/dN (inch/cycle) at 20 cpm and a $K_{eff}$ of 25 ksi $\sqrt{\text{inch}}$.

100 hour 0.2% creep (C=25) 70 ksi stress, 1365°-1392° F.

100 hour stress rupture (C=25) 70 ksi stress, 1413°-1442° F.

17. A high strength, fatigue crack growth and creep resistant nickel base superalloy article in which:

the superalloy consists, in weight percent, essentially of 12-14Co, 15-17Cr, 3.5-4.5Mo, 3.5-4.5W, 1.5-2.5Al, 3.2-4.2Ti, 0.5-1Nb, 0.01-0.04B, 0.01-0.06C, 0.01-0.06Zr, up to about 0.01V, up to about 0.3Hf, up to about 0.01Y, with the balance essentially Ni and incidental impurities;

the superalloy has a gamma prime content in the range of about 30-46 volume percent;

the average grain size is in the range of about ASTM 2-9;

the article is substantially free of quench cracking; and the article has an improved balance and combination of average tensile, creep, stress rupture and fatigue crack growth resistance from ambient up to a temperature of about 1400° F.

18. The article of claim 17 in which:

the gamma prime content is in the range of about 33 to 46 volume percent, and the article has a 750° F. fatigue crack growth rate in the range of $2.7\times10^{-6}$ to $6\times10^{-6}$ da/dN (inch/cycle) at 20 cycles per minute and a $K_{eff}$ of 25 ksi $\sqrt{\text{inch}}$.

19. The article of claim 18 which has, in combination with the 750° F. fatigue crack growth rate, an improved balance of properties of:

750° F. tensile 207-225 ksi UTS; 142-169 ksi 0.2% YS;

1200° F. fatigue crack growth rate of $1.3\times10^{-5}$ to $2.2\times10^{-5}$ da/dN (inch/cycle) at 20 cpm and a $K_{eff}$ of 25 ksi $\sqrt{\text{inch}}$.

100 hour 0.2% creep (C=25) 70 ksi stress, 1365°-1392° F.

100 hour stress rupture (C=25) 70 ksi stress, 1413°-1442° F.

20. An improved Ni-base superalloy for use in making a high strength fatigue crack growth and creep resistant article for application from ambient up to a temperature of about 1400° F.:

consisting essentially of, in weight percent, 12-14Co, 15-17Cr, 3.5-4.5Mo, 3.5-4.5W, 1.5-2.5Al, 3.2-4.2Ti, 0.5-1Nb, 0.01-0.04B, 0.01-0.06C, 0.01-0.06Zr, up to about 0.01V, up to 0.3Hf, up to 0.01Y, with the balance essentially Ni and incidental impurities;

the superalloy including a gamma prime content in the range of about 33 to 46 volume percent;

the superalloy having uniformly coarsened grains to an average grain size of about ASTM 2-9 with a substantial absence of critical grain growth;

the superalloy having substantial quench crack resistance from a supersolvus solutioning temperature to a preselected quenching temperature; and the superalloy having a strain rate sensitivity, m, of at least 0.3 at preselected superalloy working conditions.

* * * * *